US009266230B2

(12) United States Patent
Maddilate et al.

(10) Patent No.: US 9,266,230 B2
(45) Date of Patent: Feb. 23, 2016

(54) TWIST-HANDLED POWER TOOL WITH LOCKING SYSTEM

(71) Applicant: Black & Decker Inc., Newark, DE (US)

(72) Inventors: Raghavendra Maddilate, Bangalore (IN); Suhas Narasimha, Bangalore (IN); Lanka Sadanand, Bangalore (IN); Ashwin Magadi Gopinath, Bangalore (IN); Shreegoud Biradar Patil, Bangalore (IN); Amit Melge, Bangalore (IN); Joseph Kelleher, Bowie, MD (US); Gabriel Concari, Eldersburg, MD (US)

(73) Assignee: BLACK & DECKER INC., New Britain, CT (US)

( * ) Notice: Subject to any disclaimer, the term of this patent is extended or adjusted under 35 U.S.C. 154(b) by 546 days.

(21) Appl. No.: 13/834,208

(22) Filed: Mar. 15, 2013

(65) Prior Publication Data

US 2013/0199811 A1 Aug. 8, 2013

Related U.S. Application Data

(63) Continuation-in-part of application No. 12/783,850, filed on May 20, 2010, now Pat. No. 8,555,999, and a continuation-in-part of application No. 13/404,620, filed on Feb. 24, 2012, now Pat. No. 8,418,778, which (Continued)

(51) Int. Cl.
*B25B 23/00* (2006.01)
*B25F 5/02* (2006.01)

(52) U.S. Cl.
CPC ..... *B25F 5/02* (2013.01)

(58) Field of Classification Search
CPC ..... B25B 21/00; B25F 5/02
USPC ..... 173/29, 42, 45, 47, 170, 216–217; 310/50; 81/177.8, 177.85, 180.1
See application file for complete search history.

(56) References Cited

U.S. PATENT DOCUMENTS 597,469 A 1/1898 Marshall
2,542,038 A 2/1951 Lewis (Continued)

FOREIGN PATENT DOCUMENTS

EP 1657457 A1 5/2006

OTHER PUBLICATIONS

SKIL 2348 Twist Handle Screwdriver Manual dated Aug. 7, 2007.

(Continued)

*Primary Examiner* — Robert Long
(74) *Attorney, Agent, or Firm* — Harness, Dickey & Pierce, P.L.C.

(57) ABSTRACT

A power tool having first and second housing portions, a power train, a mounting hub, a lock bar and an actuator. The second housing portion is disposed about the first housing portion for pivoting motion about a pivot axis. The powertrain has an output member that extends from the second housing portion and which is movable relative to an output member axis. The mounting hub is coupled to one of the first and second housing portions. The lock bar is mounted to the other one of the first and second housing portions. The actuator is slidably received in the other one of the first and second housing portions and cooperates with the mounting hub to selectively permit the second housing portion to pivot about the pivot axis relative to the first housing portion.

19 Claims, 13 Drawing Sheets

Related U.S. Application Data is a continuation-in-part of application No. 29/406,752, filed on Nov. 18, 2011, now Pat. No. Des. 657,646, and a continuation-in-part of application No. 13/120,873, filed as application No. PCT/US2011/020511 on Jan. 7, 2011, now Pat. No. 8,286,723.

(60) Provisional application No. 61/330,076, filed on Apr. 30, 2010, provisional application No. 61/292,966, filed on Jan. 7, 2010, provisional application No. 61/389,866, filed on Oct. 5, 2010.

(56) References Cited

U.S. PATENT DOCUMENTS 4,198,558 A * 4/1980 Benty ..... A45D 20/12 132/212
4,759,240 A 7/1988 Lin
D305,975 S 2/1990 Emmerling
4,977,306 A * 12/1990 Kosaka ..... A45D 20/12 34/96
5,372,420 A 12/1994 Van Deursen et al.
6,039,126 A 3/2000 Hsieh
D441,267 S 5/2001 Heun
6,308,599 B1 * 10/2001 Fu-Hui ..... B25G 1/066 81/177.4
6,928,902 B1 * 8/2005 Eyssallenne ..... B25B 21/00 81/57.26
7,185,998 B2 3/2007 Oomori et al.
7,328,635 B2 2/2008 Hu
7,347,127 B2 3/2008 Hu
7,434,496 B2 10/2008 Hu
7,481,135 B2 1/2009 Schoenbeck et al.
7,508,679 B2 3/2009 Roehm
7,557,534 B2 7/2009 Uehlein-Proctor et al.
7,649,337 B2 1/2010 Uehlein-Proctor et al.
7,779,931 B2 8/2010 Townsan
7,932,695 B2 4/2011 Uehlein-Proctor et al.
8,322,456 B2 * 12/2012 Pozgay ..... B25B 21/00 173/1
2003/0200841 A1 10/2003 Novotny
2005/0247466 A1 * 11/2005 Andriolo ..... B25F 5/02 173/170
2006/0053762 A1 3/2006 Stover et al.
2006/0096770 A1 5/2006 Roberts
2007/0039301 A1 2/2007 Velke et al.
2008/0121074 A1 5/2008 Hu
2009/0102420 A1 4/2009 Uehlein-Proctor et al.
2010/0163265 A1 7/2010 Hozumi et al.
2010/0263896 A1 * 10/2010 Brennenstuhl ..... B25F 5/02 173/217
2011/0203821 A1 8/2011 Puzio et al.
2011/0266014 A1 11/2011 McRoberts et al.
2012/0048071 A1 3/2012 Huang
2012/0160529 A1 6/2012 Eshleman et al.
2014/0056660 A1 * 2/2014 Eshleman ..... B25B 21/00 408/9
2014/0102742 A1 * 4/2014 Eshleman ..... B25B 21/004 173/183

OTHER PUBLICATIONS

David Bonnin—European Search Report—Jun. 24, 2014—8 pages—The Hague.

* cited by examiner

TWIST-HANDLED POWER TOOL WITH LOCKING SYSTEM

CROSS-REFERENCE TO RELATED APPLICATIONS

This application is a continuation-in-part of U.S. patent application Ser. No. 12/783,850 filed on May 20, 2010, which claims the benefit of U.S. Provisional Application No. 61/330,076 filed on Apr. 30, 2010. This application is also a continuation-in-part of U.S. patent application Ser. No. 13/404,620 filed Feb. 24, 2012, which is a continuation-in-part of U.S. Design patent application No. 29/406,752, filed on Nov. 18, 2011 (now U.S. D657,646 issued Apr. 17, 2012) and a continuation-in-part of U.S. patent application Ser. No. 13/120,873 filed on May 13, 2011 (now U.S. Pat. No. 8,286,723 issued Oct. 16, 2012) which is a national phase of International Patent Application No. PCT/US2011/020511 filed Jan. 7, 2011, which claims the benefit of U.S. Provisional Application No. 61/292,966 filed on Jan. 7, 2010 and U.S. Provisional Application No. 61/389,866 filed on Oct. 5, 2010. The entire disclosure of each of the above applications is incorporated herein by reference as if fully set forth in detail herein.

FIELD

The present disclosure relates to a twist-handled power tool with a locking system.

BACKGROUND

A twist-handled power tool is disclosed in U.S. Pat. No. 5,372,420, the disclosure of which is hereby incorporated by reference as if fully set forth in detail herein. Such power tools typically include a first housing member, which can be employed as a handle, and a second housing member into which an output member of the power tool is housed. The first housing portion may be pivoted relative to the second housing member between a first position and a second position. In the first position, which is referred herein as being the "inline grip position", the first and second housing portions are aligned to one another such that the longitudinal axis of the tool is arranged about a common line, with the common line being coincident to the rotational axis of the output member. In the second position, which is referred to herein as being the "pistol grip position", the longitudinal axis of the first housing member intersects the longitudinal axis of the second housing member at a point (i.e., the axes are transverse to one another).

While such power tools are suited for their intended purpose, there remains a need in the art for an improved twist-handled power tool.

SUMMARY

This section provides a general summary of the disclosure, and is not a comprehensive disclosure of its full scope or all of its features.

In one form the teachings of the present disclosure provide a power tool with first and second housing portions, a powertrain, a mounting hub and a lock bar. The powertrain has an output member that extends from the second housing portion and which is movable relative to an output member axis. The mounting hub is fixedly coupled to one of the first and second housing portions. The lock bar is slidably mounted to the other one of the first and second housing portions for movement in a direction that is transverse to a longitudinal axis of the other one of the first and second housing portions between a locked position and a first unlocked position. The lock bar cooperates with the mounting hub in the locked position to inhibit relative rotation between the first and second housing portions. Placement of the lock bar in the first unlocked position permits relative rotation between the first and second housing portions.

In yet another form the teachings of the present disclosure provide a power tool having first and second housing portions, a power train, a mounting hub, a bar body, a pair of lock tabs and a pair of lock tab recesses. The powertrain has an output member that extends from the second housing portion and which is movable relative to an output member axis. The mounting hub is fixedly coupled to one of the first and second housing portions. The bar body is movably mounted to the other one of the first and second housing portions. The lock tabs are fixedly coupled to one of the bar body and the mounting hub. The lock tab recesses are defined by the other one of the bar body and the mounting hub. The bar body is movable between a first position and a second position. Placement of the bar body in the first position locates the lock tabs in the lock tab recesses to inhibit relative rotation between the first and second housing portions. Placement of the bar body in the second position locates the lock tabs out of alignment with the lock tab recesses to permit relative rotation between the first and second housing portions.

In still another form the teachings of the present disclosure provide a power tool with a first housing portion, a battery, a second housing portion, a powertrain, a mounting hub and a lock bar assembly. The first housing portion defines a handle. The battery is received into the first housing portion. The powertrain is received in the second housing portion and has a motor, a transmission and an output member. The output member extends from the second housing portion and is rotatable about an output member axis. The mounting hub is fixedly coupled to the second housing portion and includes a pair of annular segments that extend concentrically about a pivot axis and cooperate to define a pair of lock recesses. The mounting hub is mounted on the first housing portion to pivotally couple the first housing portion to the second housing portion for rotation about the pivot axis. The lock bar assembly includes a lock bar and a spring. The lock bar has a bar body, which is slidably mounted to the first housing portion, a pair of lock tabs and a pocket into which the spring is received. The lock bar is movable between a first unlocked position, a locked position and a second unlocked position. Each of the first and second unlocked positions the lock tabs are disposed radially between the annular segments to permit the annular segments to pass between the lock tabs. The lock tabs are disposed in-line with the annular segments when the lock bar is in the locked position.

In still another form, the present teachings provide a power tool that includes first and second housing portions, a power train, a mounting hub, a lock bar, first and second sets of stop members, a biasing spring and an actuator. The second housing portion is disposed about the first housing portion for pivoting motion about a pivot axis. The powertrain has an output member that extends from the second housing portion and which is movable relative to an output member axis. The mounting hub is coupled to one of the first and second housing portions for movement along the pivot axis. The lock bar is mounted to the other one of the first and second housing portions. The first set of stop members is coupled to the mounting hub. The second set of stop members is coupled to the lock bar. The spring biases the mounting hub toward the lock bar to cause engagement of the first set of stop members with the second set of stop members. The actuator is coupled to the other one of the first and second housing portions and is configured to move the mounting hub away from the lock bar such that the first set of stop members disengages the second set of stop members. The second housing portion is inhibited from pivoting about the pivot axis relative to the first housing portion when the first set of stop members is engaged to the set of second stop members. The second housing portion is permitted to pivot about the pivot axis relative to the first housing portion when the first set of stop members is disengaged from the set of second stop members.

In a further form, the present teachings provide a power tool having first and second housing portions, a power train, a mounting hub, a lock bar and an actuator. The second housing portion is disposed about the first housing portion for pivoting motion about a pivot axis. The powertrain has an output member that extends from the second housing portion and which is movable relative to an output member axis. The mounting hub is coupled to one of the first and second housing portions. The lock bar is mounted to the other one of the first and second housing portions. The actuator is slidably received in the other one of the first and second housing portions and cooperates with the mounting hub to selectively permit the second housing portion to pivot about the pivot axis relative to the first housing portion.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
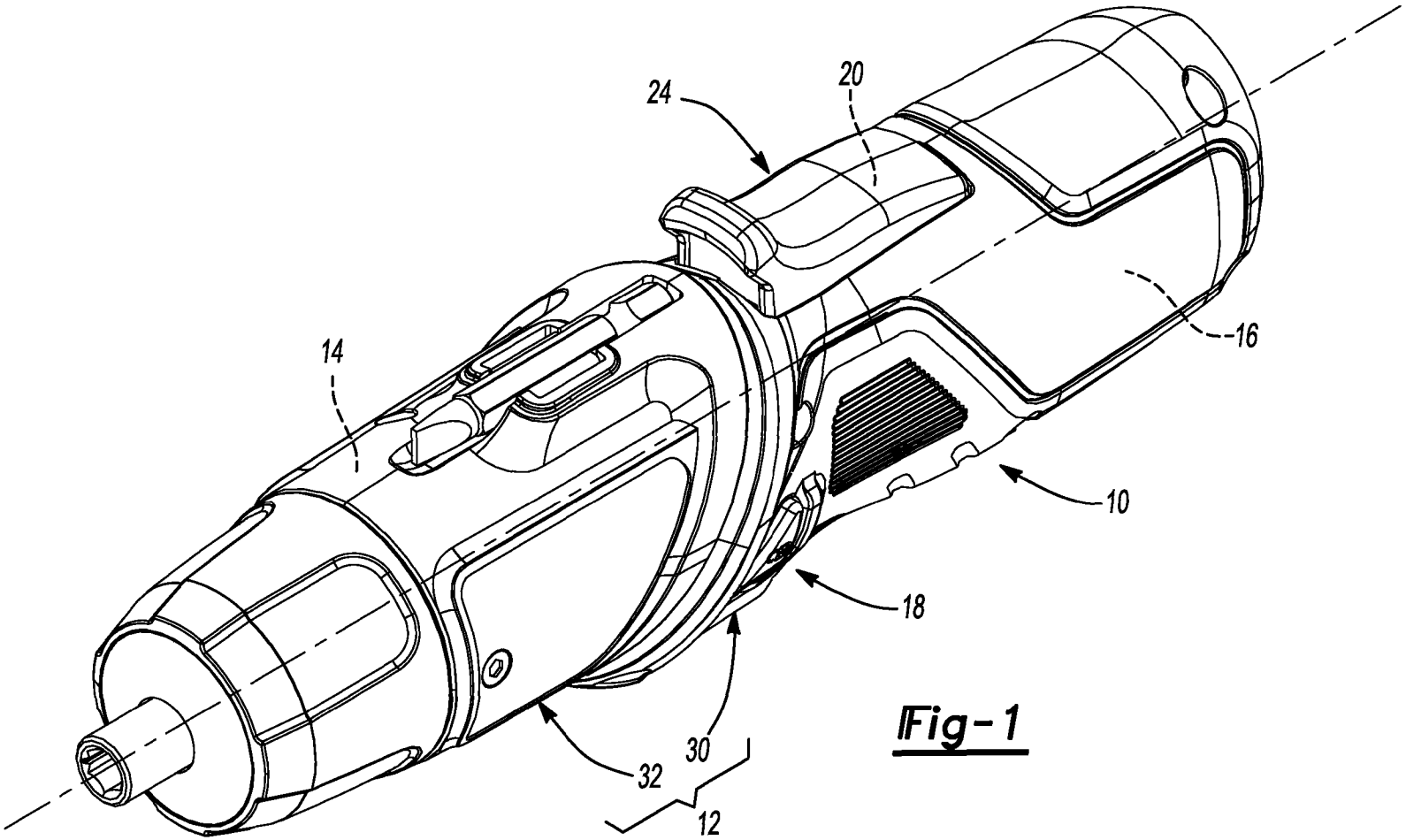
FIG. 1 is a perspective view of an exemplary twist-handled power tool constructed in accordance with the teachings of the present disclosure, the power tool being illustrated with a handle that is disposed in an inline grip position.
Figure 2:
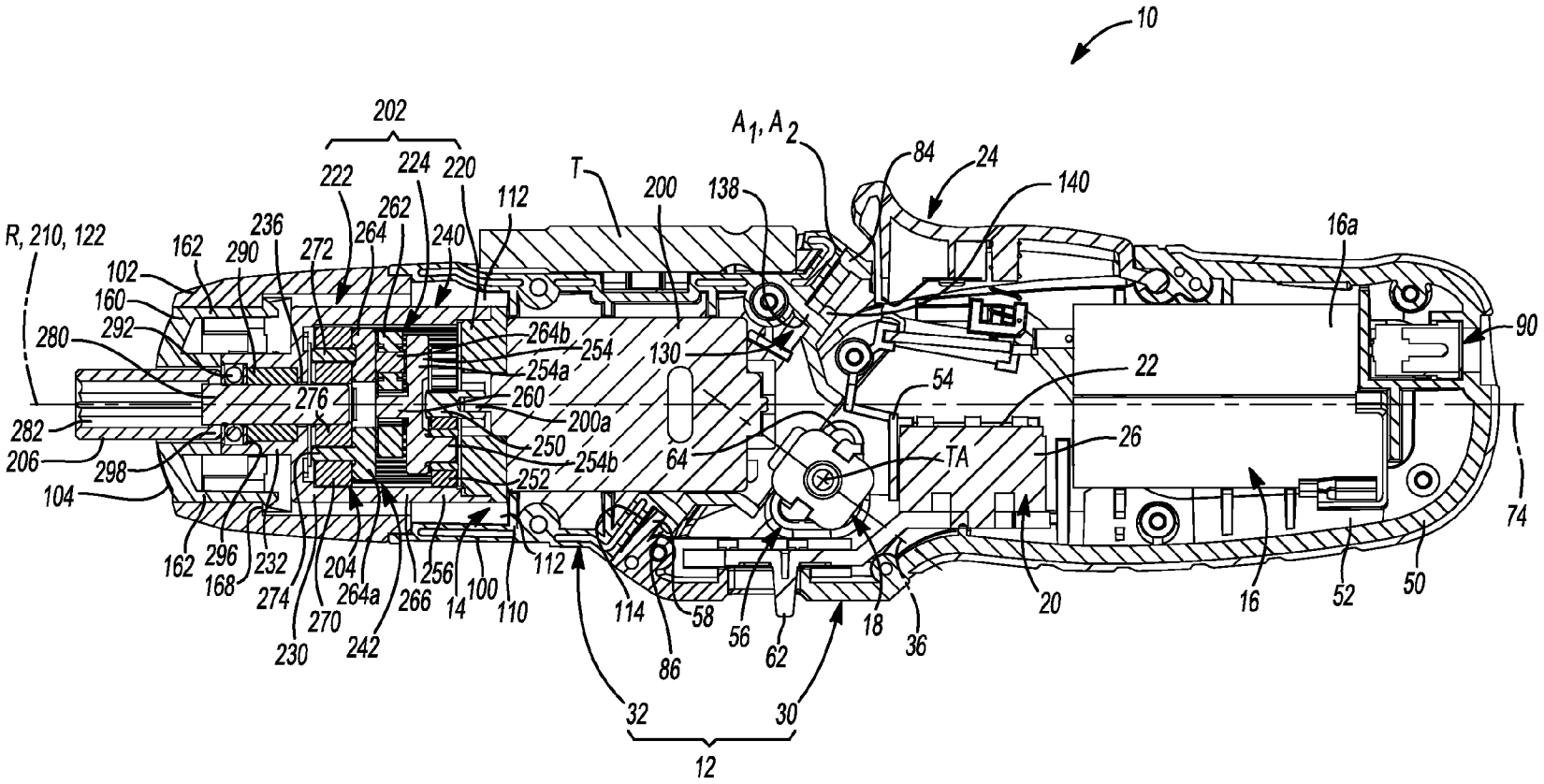
FIG. 2 is a longitudinal section view of the power tool of FIG. 1.

With reference to FIGS. 1 and 2 of the drawings, an exemplary twist-handle power tool is generally indicated by reference numeral 10. The power tool 10 can include a housing assembly 12, a powertrain 14, a battery 16, a locking system 18, and a control unit 20 that can include a controller 22, a trigger switch 24 and a reversing switch 26. While the particular power tool illustrated in the drawings and described herein is a driver that is configured to provide a rotary output, it will be appreciated that the teachings of the present disclosure have application to other types of power tools, including tools that are configured to produce a reciprocating output (e.g., sander, reciprocating saw).

Figure 3:
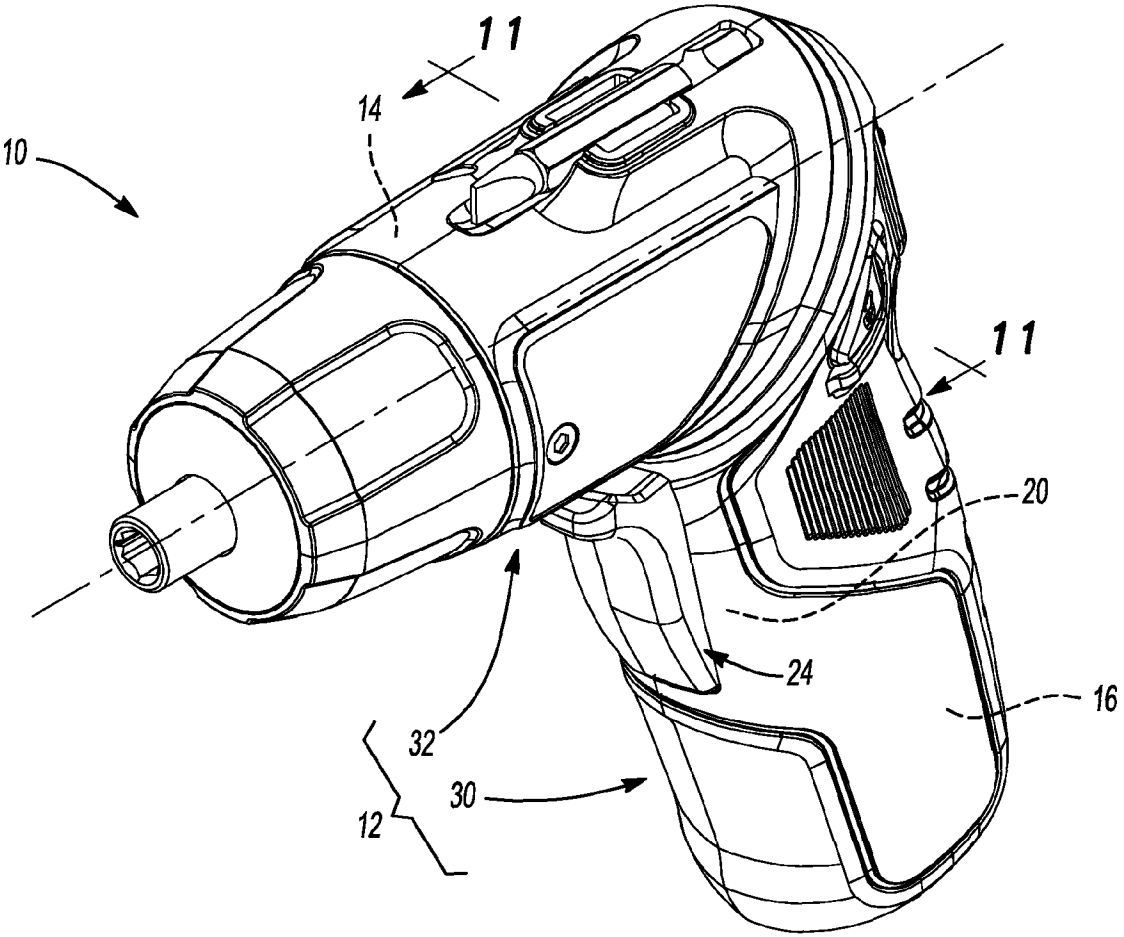
FIG. 3 is a perspective view of the power tool of FIG. 1 with the handle being disposed in a pistol grip position.

The housing assembly 12 can include a first housing portion 30 and a second housing portion 32. The first housing portion 30 can define a handle of the powertool 10 and can be mounted to the second housing portion 32 for rotation about a rotational axis 36 between a first position (i.e., an inline grip position), which is shown in FIG. 1, and a second position (i.e., a pistol grip position) that is shown in FIG. 3.

Figure 4:
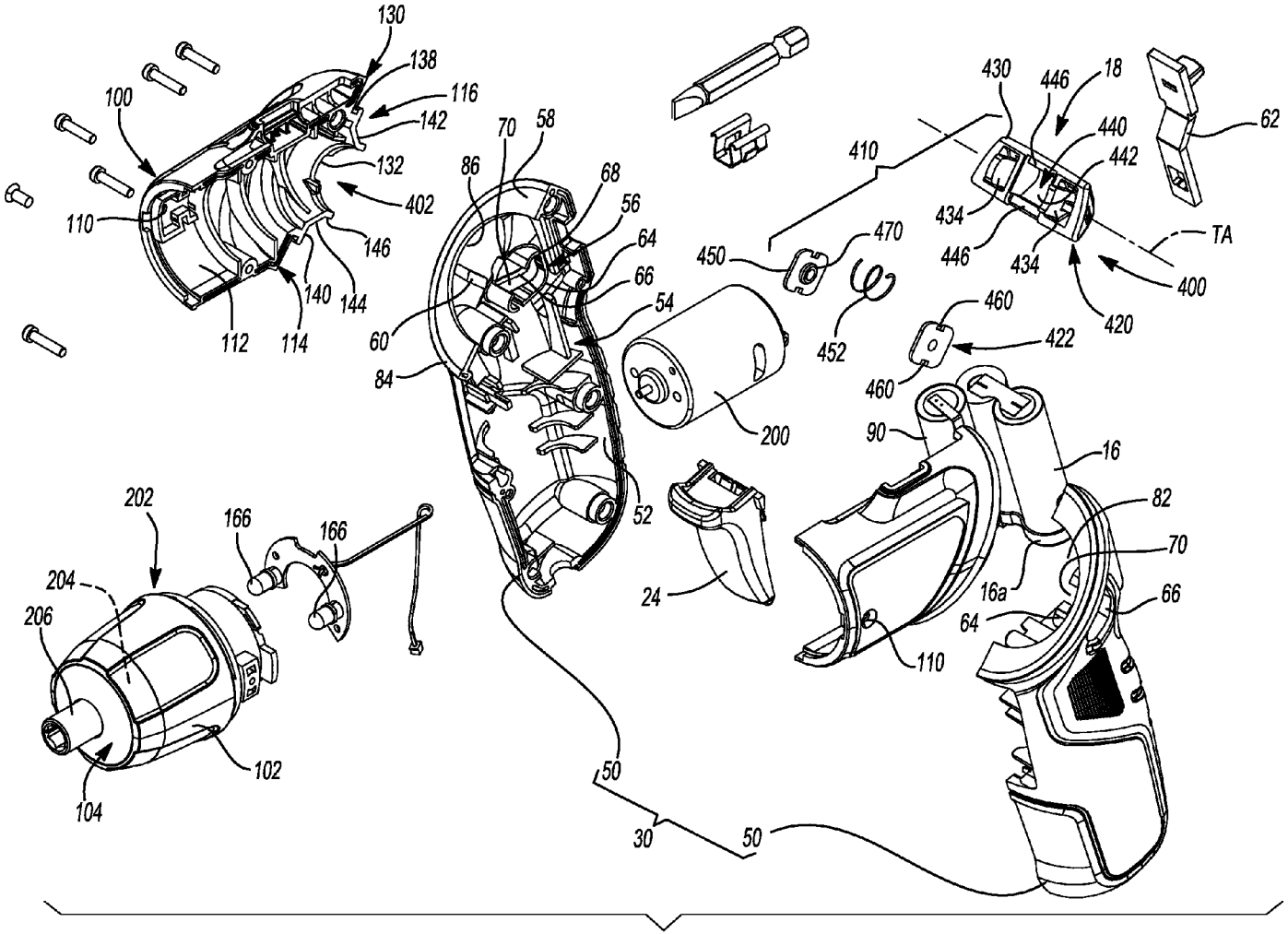
FIG. 4 is an exploded perspective view of a portion of the power tool of FIG. 1.

With reference to FIGS. 2 and 4, the first housing portion 30 can be formed of a pair of first housing shells 50 that can cooperate to define an internal cavity 52, a controller mount 54, a lock bar mount 56, a first inclined wall 58 and one or more first stop members 60. The internal cavity 52 can be configured to receive the battery 16, which can conventionally comprise one or more battery cells 16*a*. The controller mount 54 can be configured to receive the control unit 20 such that the controller 22 is fixedly mounted within the first housing portion 30, the trigger switch 24 is pivotally coupled to the first housing portion 30 and a reversing lever 62 associated with the reversing switch 26 is supported for sliding movement relative to the first housing portion 30. The lock bar mount 56 can comprise a pair of rib structures 64, with each of the rib structures 64 being formed on a corresponding one of the first housing shells 50. Each rib structure 64 can be disposed partly or completely about a perimeter of a lock bar aperture 66 formed through an associated one of the first housing shells 50. In the example provided, each rib structure 64 defines an abutment surface 68, which can be disposed at a first predetermined distance from a rotational axis 36 and a recess 70 that extends away from the rotational axis 36 by a second predetermined distance that is greater than the first predetermined distance. The first inclined wall 58 can be transverse to a longitudinal axis 74 of the first housing portion 30 and perpendicular to the rotational axis 36 and in the particular example provided, the first inclined wall 58 is disposed at a 45 degree angle to the longitudinal axis 74 of the first housing portion 30. The first inclined wall 58 can define a central aperture 82 and a raised rim member 84 that forms a first abutment surface that is configured to contact the second housing portion 32 as will be explained in more detail below. An annular slot 86 can be formed in the first housing portion 30 between the first inclined wall 58 and the lock bar mount 56. In the example provided, a first stop member 60 is provided on each of the first housing shells 50 between the annular slot 86 and the lock bar mount 56 and generally in-line with the recess 70 in the rib structure 64.

In the particular example provided, the battery 16 is received into internal cavity 52 and is not removed from the first housing portion 30 when it is recharged. Accordingly, charging terminals 90 can be mounted to the first housing portion 30 and electrically coupled to the battery 16 to facilitate the recharging of the battery 16 in a known manner (e.g., through contact of the charging terminals 90 with corresponding terminals (not shown) of a charging cradle or a charging cable).

Figure 5:
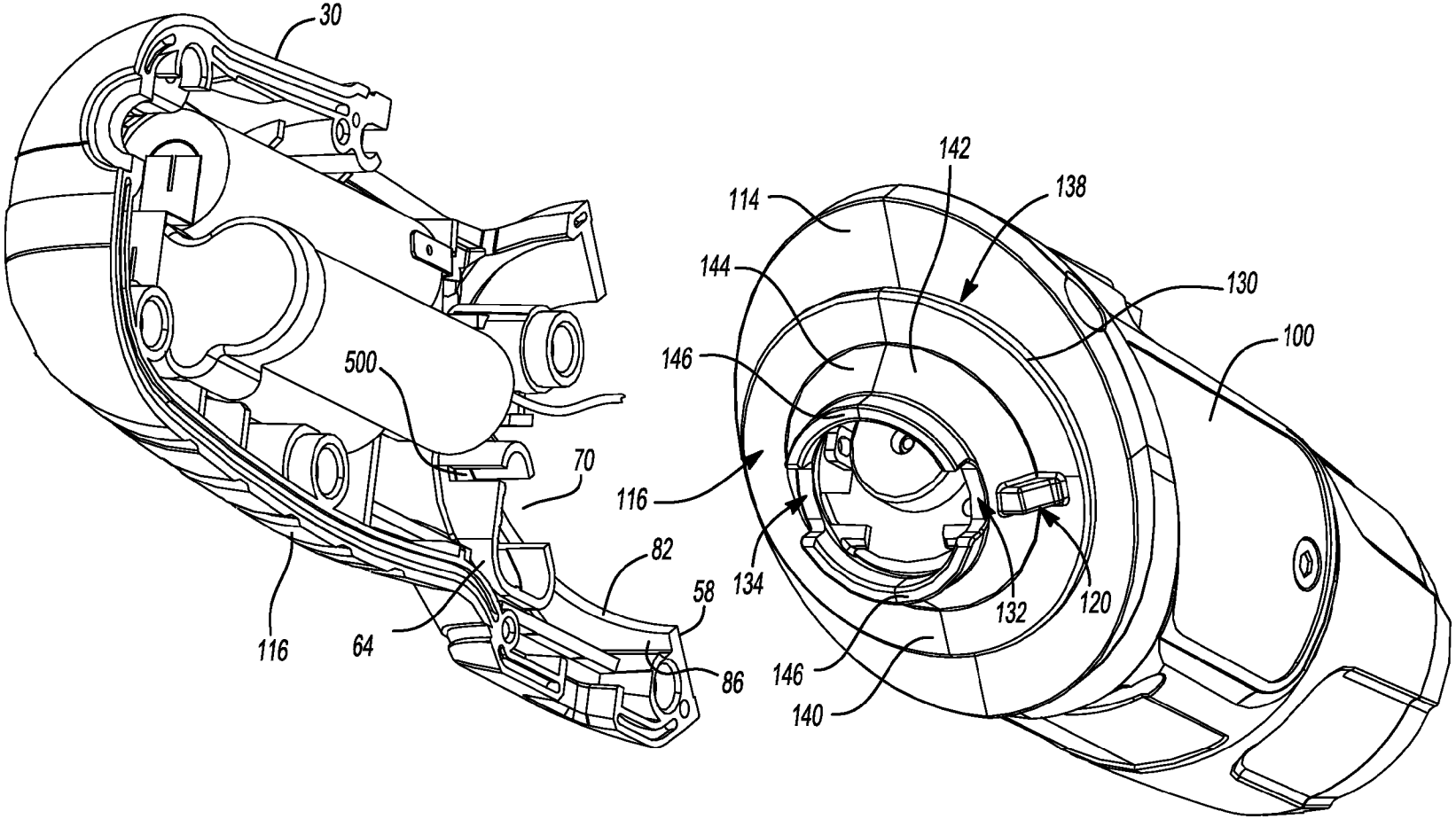
FIG. 5 is an exploded perspective view of a portion of the power tool of FIG. 1, illustrating the interface between the first and second housing portions in more detail.

With reference to FIGS. 2, 4 and 5, the second housing portion 32 can comprise a housing shell assembly 100, a nose cover 102 and a lens structure 104. The housing shell assembly 100 can be formed of a pair of second housing shells 110 that can cooperate to define an internal cavity 112, a second inclined wall 114, a mounting hub 116 and one or more second stop members 120. The internal cavity 112 can be configured to house at least a portion of the powertrain 14. The second inclined wall 114, which can be disposed on a proximal end of the housing shell assembly 100, can be disposed transverse to a longitudinal axis 122 of the second housing portion 32 and perpendicular to the rotational axis 36 and in the particular example provided, the second inclined wall 114 is disposed at a 45 degree angle to the longitudinal axis 122 of the second housing portion 32. The second inclined wall 114 can define a second abutment surface that can abut the first abutment surface, which is formed by the raised rim member 84 on the first inclined wall 58. Abutment of the first and second abutment surfaces is indicated at (A1, A2) in FIG. 2. The mounting hub 116 can extend from the second inclined wall 114 toward the first housing portion 30 and can include a hub structure 130 and first and second hub recesses 132 and 134, respectively. The hub structure 130 can comprise an annular hub 138, which can be disposed concentrically about the rotational axis 36 and generally perpendicular to the second inclined wall 114, and a flange member 140 that can extend radially outwardly from the annular hub 138. The annular hub 138 is sized to be received in a slip fit manner into the central aperture 82 to permit the first housing portion 30 to rotate about the rotational axis 36 relative to the mounting hub 116 (and thus the second housing portion 32). The flange member 140, which can be received in the annular slot 86, can be spaced apart from the second inclined wall 114 by a distance that permits free rotation of the first housing portion 30 relative to the mounting hub 116 but which controls side play (i.e., pivoting of the first housing portion 30 relative to the second inclined wall 114) by a desired degree. In the example provided, a side of the flange member 140 that faces the second inclined wall 114 is formed parallel to the second inclined wall 114 and abuts a side of the first inclined wall 58 opposite the second inclined wall 114. The first and second hub recesses 132 and 134 can be formed in the mounting hub 116 at a location proximate the recesses 70 in the rib structure 64 when the housing shell assembly 100 is mounted to the first housing portion 30. In the particular example provided, a wall member 142 extends from the flange member 140 in a direction away from the second inclined wall 114 and includes a frustoconical portion 144 and a pair of annular segments 146, each of which forming a corresponding one of the first and second hub recesses 132 and 134. The annular segments 146 can be disposed concentrically about the rotational axis 36. The second stop member(s) 120 can be coupled to the mounting hub 116 and can cooperate with the first stop member(s) 60 to limit rotation of the first housing portion 30 about the rotational axis 36 relative to the second housing portion 32. In the example provided, a single second stop member 120 is employed and cooperates with the first stop members 60 to align the first and second hub recesses 132 and 134 to the recesses 70 in the rib structure 64 when the first housing portion 30 is placed in the first and second positions. More specifically, contact between the second stop member 120 and the first stop member 60 on a first one of the first housing shells 50 will align the first and second hub recesses 132 and 134 to the recess 70 in the rib structure 64 when the first housing portion 30 is in the first position, and contact between the second stop member 120 and the first stop member on the other one of the first housing shells 50 will align the first and second hub recesses 132 and 134 to the recess 70 in the rib structure 64 when the first housing portion 30 is in the second position.

With reference to FIGS. 2 and 4, the nose cover 102 can be coupled to the distal end of the housing shell assembly 100 (i.e., the end opposite the second inclined wall 114) and can effectively extend the internal cavity 112, as well as clamp around the distal end of the housing shell assembly 100 to help prevent separation of the second housing shells 110. While the particular example depicted in the drawings illustrates a nose cover 102 that is discrete and separate from the second housing shells 110 that form the housing shell assembly 100, it will be appreciated that the nose cover 102 could be integrally formed with the housing shell assembly 100 in the alternative.

The lens structure 104 can be formed of a suitable plastic material, such as a clear plastic, and can be received into an end of the nose cover 102 opposite the housing shell assembly 100. The lens structure 104 can define a lens 160 and a plurality of engagement arms 162. The lens 160 can be configured to collect light from a light source received in the nose cover 102, such as a pair of LED lamps 166 which can be electrically coupled to the control unit 20 and the battery 16, and to diffuse the collected light in a desired manner. The engagement arms 162 can extend rearwardly from the lens 160 and can be secured to an annular ridge or rim 168 formed in the nose cover 102. It will be appreciated that the engagement arms 162 can be received into corresponding longitudinally extending grooves (not specifically shown) in the nose cover 102 to thereby inhibit rotation of the lens structure 104 relative to the nose cover 102. It will also be appreciated that the engagement arms 162 can be resiliently deflectable relative to the lens 160 so as to deflect in a radially inward direction as the lens structure 104 is inserted into the nose cover 102 and prior to engagement of the engagement arms 162 with the annular rim 168. If desired, a reflector (not specifically shown) can be mounted in the nose cover 102 rearwardly of the light source to reflect light forwardly through the lens 160.

The powertrain 14 can include a motor 200, a transmission assembly 202, a spindle lock 204 and an output member 206.

The motor 200 can be an electric motor that can be electrically coupled to the battery 16 and the trigger switch 24. The motor 200 can be mounted in the interior cavity 112 of the housing shell assembly 100 such that a rotational axis 210 of the output shaft 200*a* of the motor 200 is disposed about (i.e., concentrically with) the longitudinal axis 122 of the second housing portion 32.

The transmission assembly 202 can include a mounting plate 220, which can be mounted to the motor 200, a gear case housing 222 and a transmission 224. The gear case housing 222 can include a cup-like gear case 230 and a spindle mount 232. The gear case 230 can be mounted to the mounting plate 220 to thereby fixedly couple the motor 200 and the gear case housing 222 to one another. The spindle mount 232 can be an annular structure that can extend axially away from the gear case 230 on a side opposite the motor 200. An output member aperture 236 can extend through the gear case 230 and the spindle mount 232.

The transmission 224 can be received in the gear case 230 and can transmit rotary power between the output shaft 200*a* of the motor 200 and the output member 206. In the particular example provided, the transmission 224 is a two-stage, single speed planetary transmission with a first planetary stage 240 and a second planetary stage 242, but it will be appreciated that any suitable transmission, including a multi-speed transmission, could be employed in the alternative. The first planetary stage 240 can include a first sun gear 250, a plurality of first planet gears 252, a first planet carrier 254 and a first ring gear 256. The first sun gear 250 can be coupled to the output shaft 200*a* of the motor 200 for rotation therewith and can be meshingly engaged with the first planet gears 252. The first planet carrier 254 can include a carrier body 254*a* and a plurality of pins 254*b* that can be fixedly coupled to the carrier body 254*a*. Each of the first planet gears 252 can be mounted for rotation on a corresponding one of the pins 254*b*. The first ring gear 256 can be meshingly engaged with the first planet gears 252. In the example provided, the first ring gear 256 is integrally formed with the gear case 230.

The second planetary stage 242 can include a second sun gear 260, a plurality of second planet gears 262, a second planet carrier 264 and a second ring gear 266. The second sun gear 260 can be coupled to the carrier body 254*a* of the first planet carrier 254 for rotation therewith and can be meshingly engaged with the second planet gears 262. The second planet carrier 264 can include a carrier body 264*a* and a plurality of pins 264*b* that can be fixedly coupled to the carrier body 264*a*. Each of the second planet gears 262 can be mounted for rotation on a corresponding one of the pins 264*b*. The second ring gear 266 can be meshingly engaged with the second planet gears 262. In the example provided, the second ring gear 266 is integrally formed with the gear case 230.

The spindle lock 204 is conventional in its construction and operation and can comprise an outer collar 270, a plurality of lock pins 272, a plurality of projections 274, which can be integrally formed with the carrier body 264*a* of the second planet carrier 264, and an anvil 276. The outer collar 270 can be an annular structure that can be non-rotatably engaged to the gear case 230. The lock pins 272 can extend longitudinally parallel to the rotational axis R of the output member 206 between the projections 274 and an interior surface of the outer collar 270. The anvil 276 can be received in the gear case 230 within the projections 274 and in-line with the output member aperture 236.

The output member 206 can be received into the spindle mount 232 and through the output member aperture 236. In the particular example provided, the output member 206 includes a solid shaft portion 280 and a larger diameter hollow tool holder portion 282 having a hex-shaped aperture that is configured to drivingly engage a hex shaped bit or tool T. One or more bearings may be employed to support the output member 206 for rotation relative to the gear case housing 222 and/or to transmit thrust loads from the output member 206 to the gear case housing 222. For example, a journal bearing 290 could be mounted on the shaft portion 280 to support the output member 206 for rotation relative to the gear case housing 222 and a thrust bearing 292 can be received over the shaft portion 292 and abutted against a shoulder 296 in the spindle mount 232 and a shoulder 298 on the output member 206 to transmit axially directed thrust loads from the output member 206 to the gear case housing 222.

The shaft portion 280 of the output member 206 can be drivingly engaged to the anvil 276 in a manner that permits limited rotation of the output member 206 relative to the anvil 276. The anvil 276 is configured to cooperate with the lock pins 272 and the outer collar 270 to permit the anvil 276 to be rotated by the second planet carrier 264 to thereby drive the output member 206, but to lock (i.e., via contact between the anvil 276, the lock pins 272 and the outer collar 270) when a torsional input is provided through the output member 206 that would tend to back-drive the transmission 224.

Figure 6:
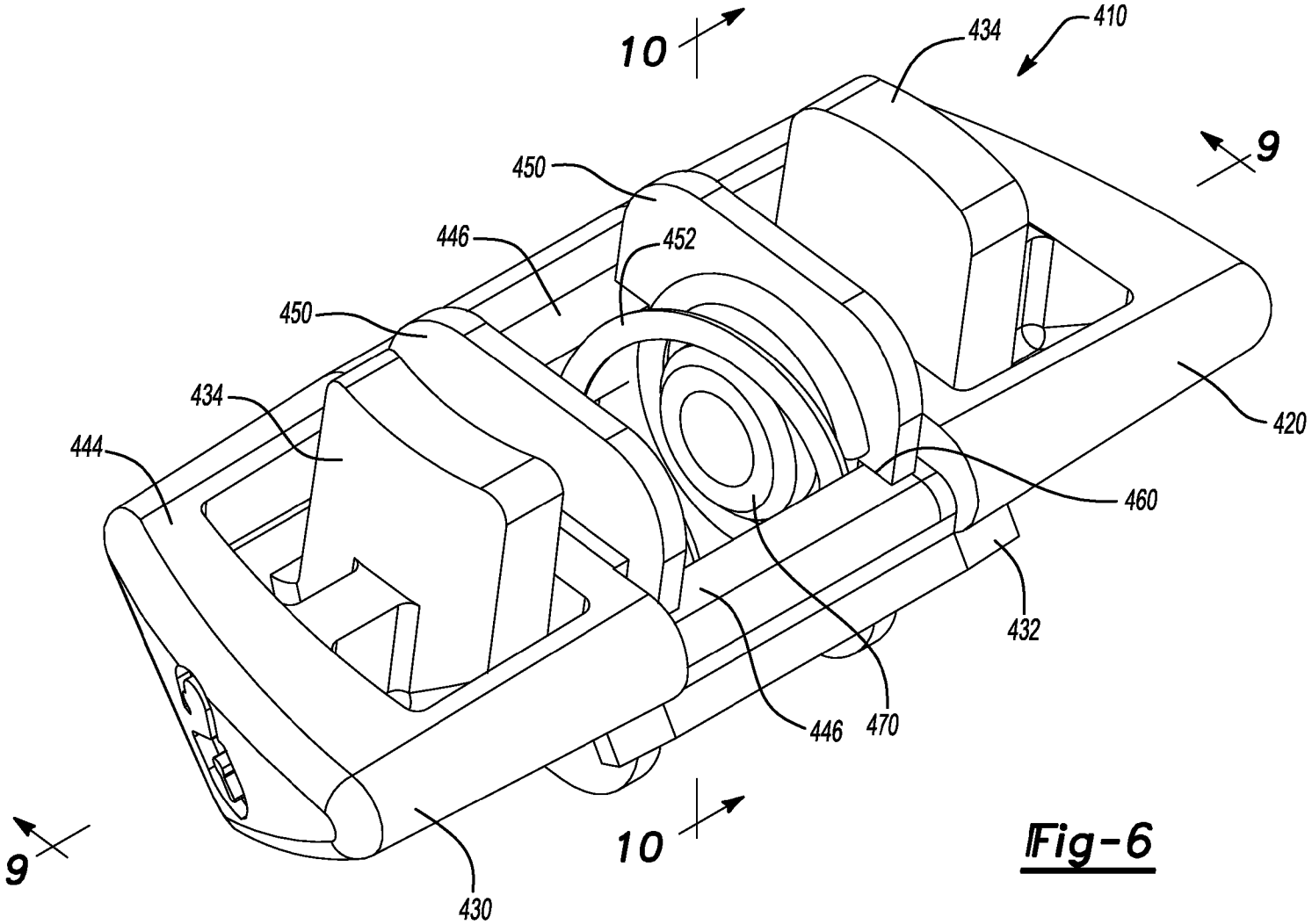
FIG. 6 is a perspective view of a portion of the power tool of FIG. 1, illustrating a lock bar assembly in more detail.
Figure 7:
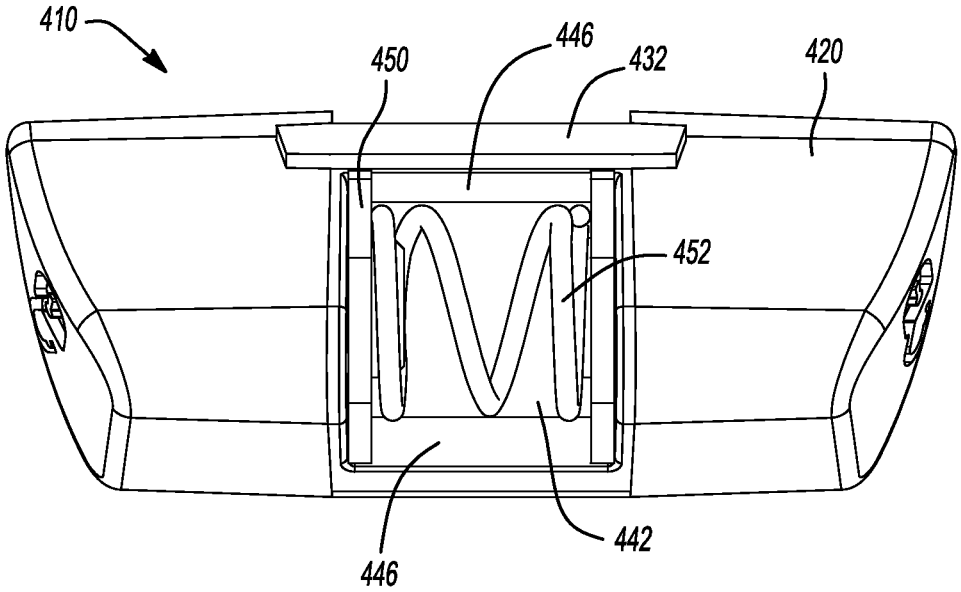
FIGS. 7 and 8 are bottom and side perspective views of the lock bar assembly of FIG. 6.
Figure 8:
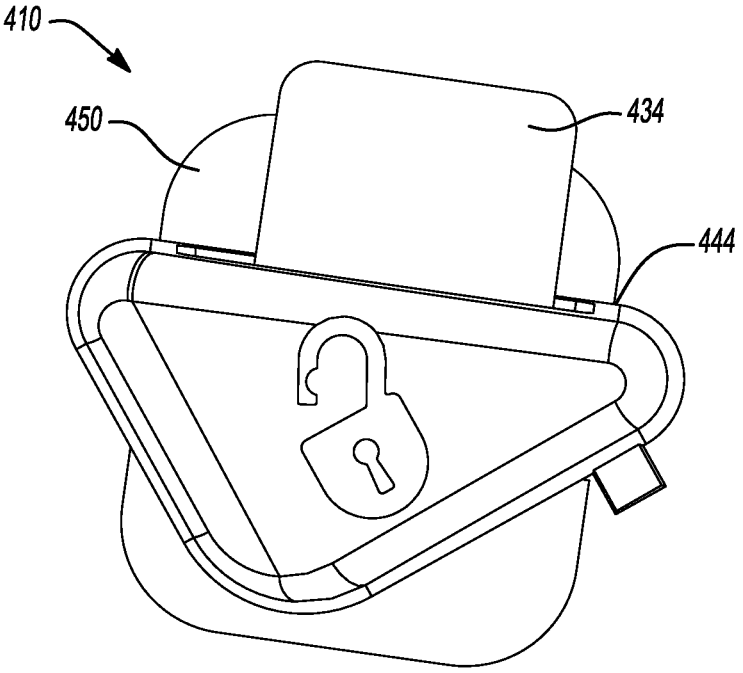
Figure 9:
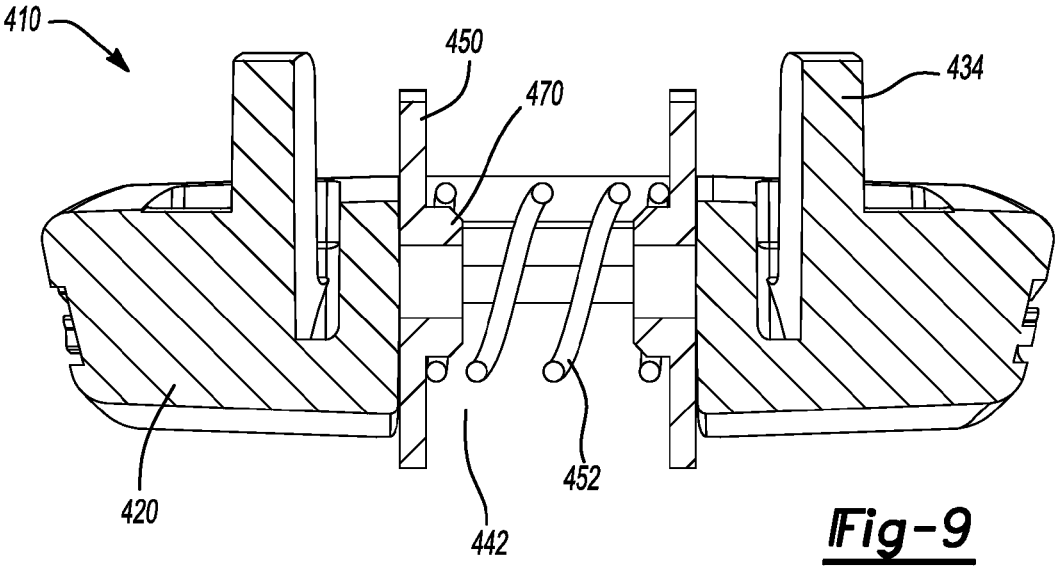
FIG. 9 is a section view taken along the line 9-9 of FIG. 6.
Figure 10:
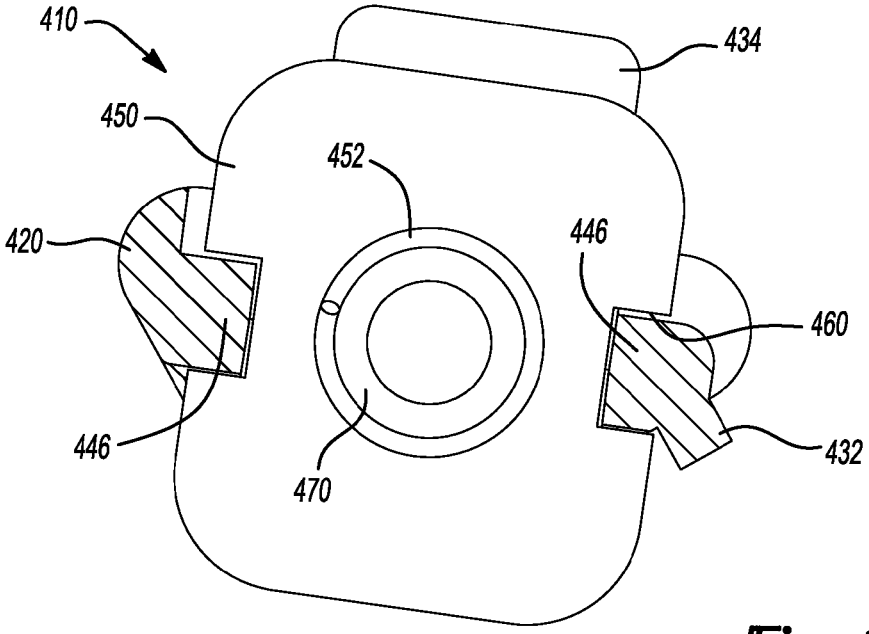
FIG. 10 is a section view taken along the line 10-10 of FIG. 6.
Figure 12:
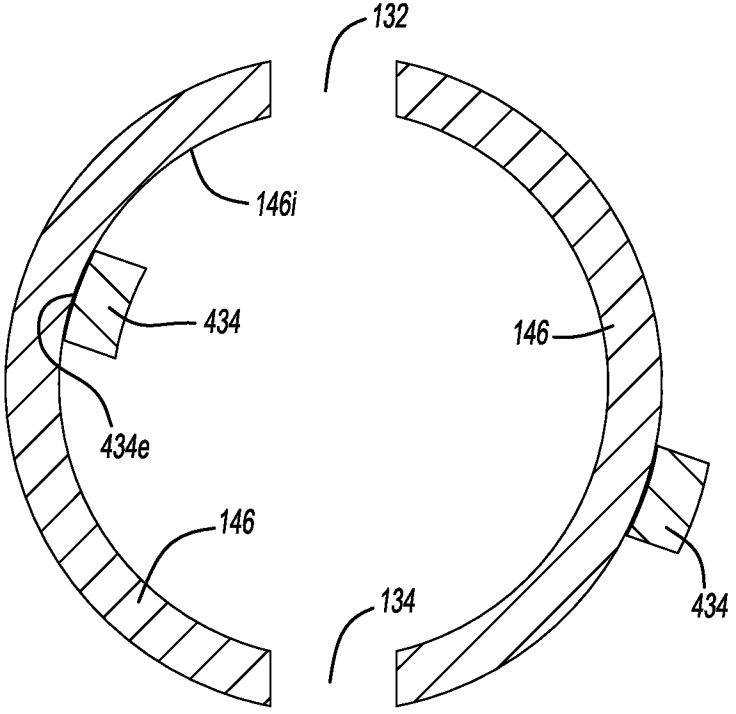
FIG. 12 is a section view similar to that of FIG. 11 but depicting the portion of the lock bar assembly relative to the portion of the mounting hub when the handle is in a position that is between the in-line grip position and the pistol-grip position.

With reference to FIGS. 4 through 6, the locking system 18 can comprise a lock bar system 400, which can be mounted to one of the first and second housing portions 30 and 32, and a set of locking features 402 that are coupled to the other one of the first and second housing portions 30 and 32. In the particular example provided, the lock bar system 400 is associated with the first housing portion 30, while the set of locking features 402 is associated with the second housing portion 32. The lock bar system 400 can comprise the lock bar mount 56 and a lock bar assembly 410, which can be slidably received into the lock bar mount 56.

With reference to FIGS. 4 and 6-10, the lock bar assembly 410 can comprise a lock bar 420 and a biasing system 422. The lock bar 420 can comprise a bar body 430, a guide member 432 and a pair of stop members 434. The bar body 430 can be an elongate structure that can define a non-circularly shaped cross-section and a pocket 440 into which the biasing system 422 can be received. In the example provided, the bar body 430 defines a cross-section having a right-triangular shape in which the shorter sides are of a non-equal length. It will be appreciated that the lock bar apertures 66 and the rib structures 64 associated with the first housing portion 30 can be shaped in a complementary fashion. The pocket 440 can be tailored to the particular configuration of the biasing system 422 and in the particular example provided, includes a generally rectangular aperture 442, which extends through the bar body 430 generally perpendicular to the hypotenuse 444 of the right-triangular cross-sectional shape of the bar body 430, and a pair of guide rails 446 that extend generally parallel to the hypotenuse 444. The guide member 432 can be a rail-like structure that can be integrally formed with the bar body 430 and extend generally perpendicular from one of the sides of the right-triangularly shaped cross-section of the bar body 430. The stop members 434 can also be integrally formed with the bar body 430 and can comprise annular segments that are coupled to and extend outwardly from the bar body 430 generally perpendicular to the hypotenuse 444 of the right-triangular cross-sectional shape of the bar body 430. The stop members 434 can be disposed on opposite sides of the aperture 442 in the pocket 440.

The biasing system 422 can comprise a pair of plate members 450 and a spring 452. The plate members 450 can be shaped in a desired manner and can be received into the aperture 442 of the pocket 440 and engaged to the guide rails 446. In the particular example provided, the plate members 450 are generally rectangular in shape and include a pair of guide notches 460 that are complementary to the contour of the guide rails 446. The spring 452 can be received between the plate members 450 and can bias the plate members 450 away from one another and against the opposite sides of the pocket 440. If desired, one or both of the plate members 450 can be configured with a spring hub 470 that is configured to be received within the spring 452; the spring hub(s) 470 can be employed to aid in retaining the spring 452 to one or both of the plate members 450 and/or to limit the amount by which the spring 452 may be compressed (e.g., through contact with another structure, such as contact between two hubs 470).

The set of locking features 402 can be integrally formed with the housing shell assembly 100 of the second housing portion 32. In the particular example provided, the set of locking features 402 comprises the first and second hub recesses 132 and 134 that are formed in the mounting hub 116.

Figure 11:
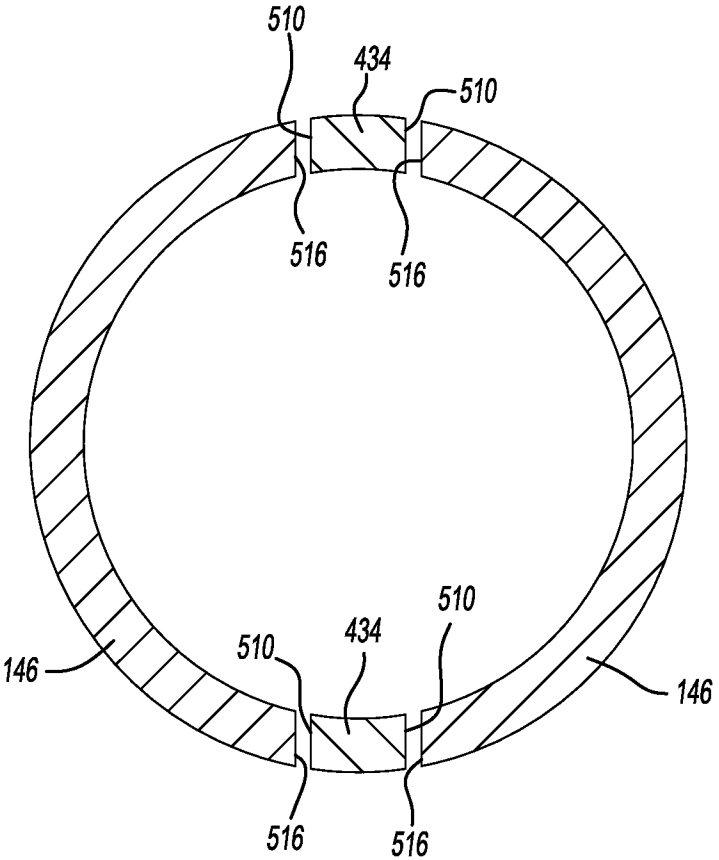
FIG. 11 is a section view of a portion of the tool of FIG. 1 illustrating the a portion of the lock bar assembly relative to a portion of the mounting hub when the handle in the in-line grip position or the pistol-grip position.

With reference to 2 and 4 through 6, when the lock bar assembly 410 is slidably received into the lock bar mount 56, the hypotenuse 444 of the cross-sectional shape of the lock bar 420 can be generally parallel to the first and second inclined walls 58 and 114 and generally perpendicular to the rotational axis 36; the guide member 432 on the lock bar 420 can be received into corresponding guide slots 500 (FIG. 5) formed in the rib structures 64 and one or both of the plate members 450 of the biasing system 422 can abutted against a corresponding ones of the abutment surfaces 68 formed on the rib structures 64. When the first housing portion 30 is in one of the first and second positions, the biasing system 422 can cooperate with both of the abutment surfaces 68 to orient (e.g., center) the lock bar 420 relative to the mounting hub 116 such that the stop members 434 are received into the first and second hub recesses 132 and 134 and rotationally inline with the annular segments 146 of the mounting hub 116 to thereby inhibit rotation of the first housing portion 30 relative to the second housing portion 32. With additional reference to FIG. 11, end faces 510 of the stop members 434 are positioned to contact end faces 516 of the annular segments 146 to limit or prevent rotational movement of the first housing portion 30 relative to the second housing portion 32 about the rotational axis 36.

With reference to FIGS. 2, 4 through 6 and 12, when a change in the position of the first housing portion 30 relative to the second housing portion 32 is desired, a force may be applied to the lock bar 420 to translate the lock bar 420 along a translation axis TA that is perpendicular to the rotational axis 36 such that one of the stop members 434 is disposed radially inward of the annular segments 146 and the other one of the stop members 434 is disposed radially outwardly of the annular segments 146. With a slight rotation of the first housing portion 30 relative to the second housing portion 32 about the rotational axis 36 the stop members 434 will at least partly overlie the annular segments 146 and as such, the force applied to the lock bar 420 may be released, which permits spring 452 of the biasing system 422 to urge the lock bar 420 in a direction away from the single or sole one of the plate members 450 that is in contact with an associated one of the abutment surfaces 68 such that an exterior annular surface **434*e* of the stop member 434 that is located radially inward of the annular segments 146 to abut an interior annular surface 146*i* of one of the annular segments 146. When the first housing portion 30 is rotated relative to the second housing portion 32 to one of the first and second positions, the stop members 434 will be disposed in-line with the first and second recesses 132 and 134 and as such, the biasing force applied by the spring 452 will urge the lock bar 420 along the translation axis TA such that the stop members 434 are received in the first and second recesses 132 and 134 and interposed between the annular segments 146 to thereby inhibit further rotation of the first housing portion 30 relative to the second housing portion 32 about the rotational axis 36**.

Figure 13:
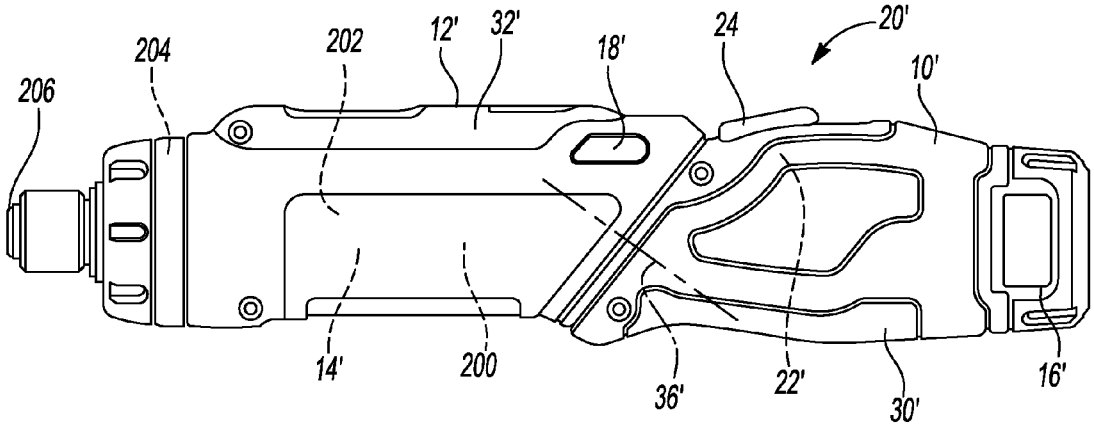
FIG. 13 is a side elevation view of a second exemplary twist-handled power tool constructed in accordance with the teachings of the present disclosure, the power tool being illustrated with a handle that is disposed in an inline grip position.
Figure 14:
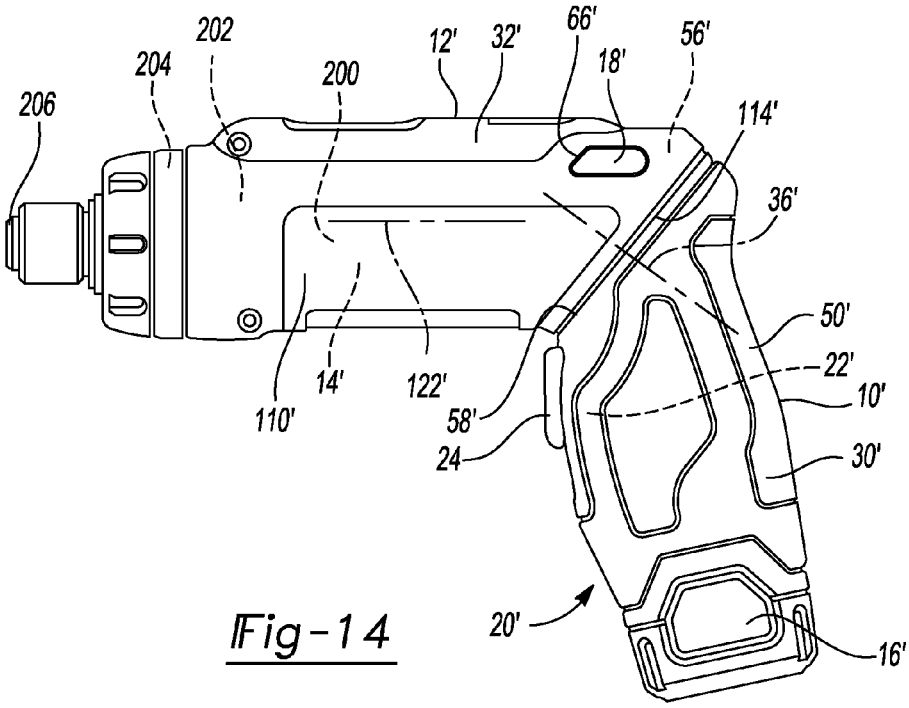
FIG. 14 is a side elevation view of the power tool of FIG. 13 with the handle being disposed in a pistol grip position.

With reference to FIGS. 13 and 14 of the drawings, another exemplary twist-handle power tool is generally indicated by reference numeral 10'. The power tool 10' can include a housing assembly 12', a powertrain 14', a battery 16', a locking system 18', and a control unit 20' that can include a controller 22' and a trigger switch 24. While the particular power tool illustrated in the drawings and described herein is a driver that is configured to provide a rotary output, it will be appreciated that the teachings of the present disclosure have application to other types of power tools, including tools that are configured to produce a reciprocating output (e.g., sander, reciprocating saw).

The powertrain 14' can be constructed in a manner that is generally similar to the powertrain 14 (FIG. 1) described in detail above. The battery 16' can be a conventionally constructed rechargeable battery pack and can be received into and coupled to the housing assembly 12' in a conventional manner. The control unit 20' can be conventional in its construction and operation and can be employed via the trigger switch 24 and the controller 22' to control the distribution of electrical energy from the battery 16' to the powertrain 14'.

The housing assembly 12' can include a first housing portion 30' and a second housing portion 32'. The first housing portion 30' can define a handle of the power tool 10' and can be mounted to the second housing portion 32' for rotation about a rotational axis 36' between a first position (i.e., an inline grip position), which is shown in FIG. 13, and a second position (i.e., a pistol grip position) that is shown in FIG. 14.

Except as described herein, the first and second housing portions 30' and 32' can be generally similar to the first and second housing portions 30 and 32 (FIG. 1) described in detail above. Briefly, and with reference to FIG. 15, the first housing portion 30' can include a pair of first housing shells 50' and a mounting hub 116'. The first housing shells 50' can cooperate to define a first inclined wall 58', a mounting hub aperture 1000, and one or more first stop members 60'. The first inclined wall 58' can be transverse to a longitudinal axis 74' of the first housing portion 32' and perpendicular to the rotational axis 36'. In the particular example provided, the first inclined wall 58' is disposed at a 45 degree angle to the longitudinal axis 74' of the first housing portion 30'. The mounting hub aperture 1000 can be formed through the first inclined wall 58' and can be sized to receive the mounting hub 116'.

Figure 16:
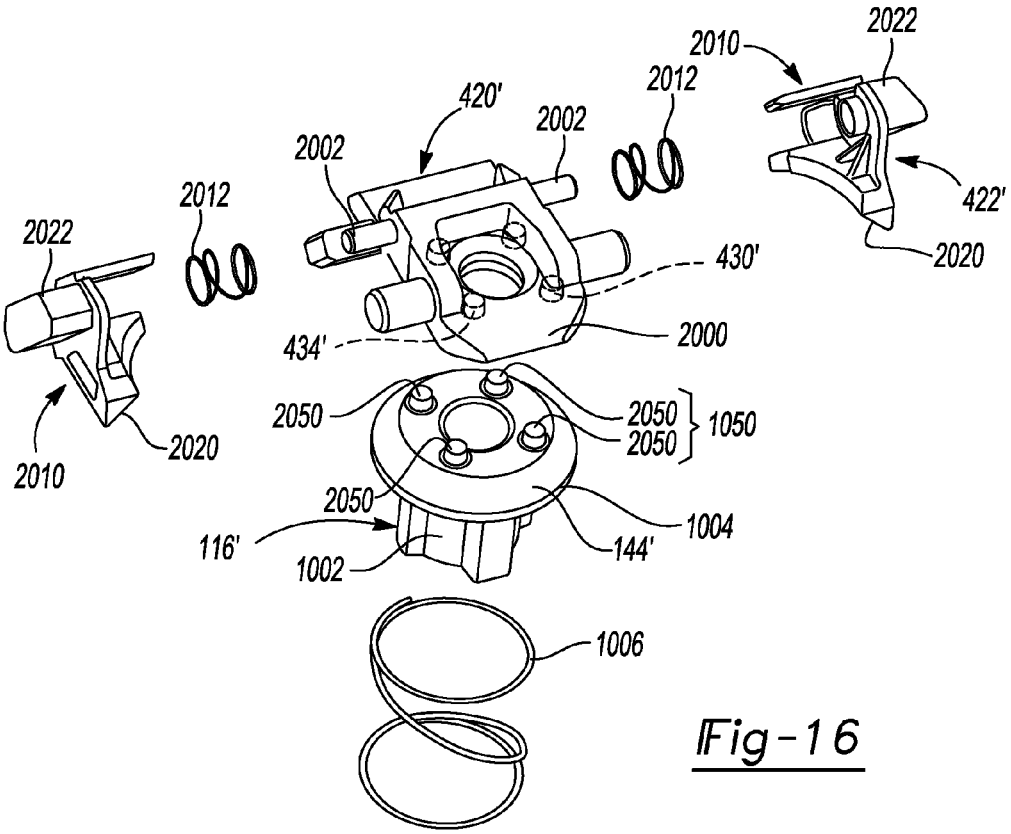
FIG. 16 is an exploded perspective view of a portion of the power tool of FIG. 13, illustrating the locking mechanism in more detail.
Figure 17:
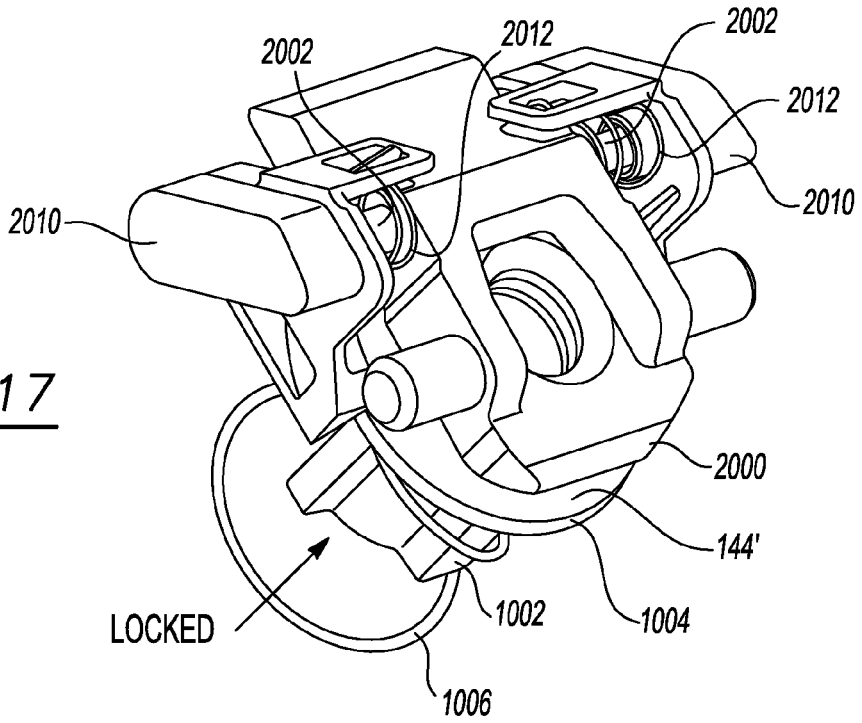
FIGS. 17 and 18 are perspective views of the portion of the power tool shown in FIG. 16, illustrating the locking mechanism in a locked condition.
Figure 18:
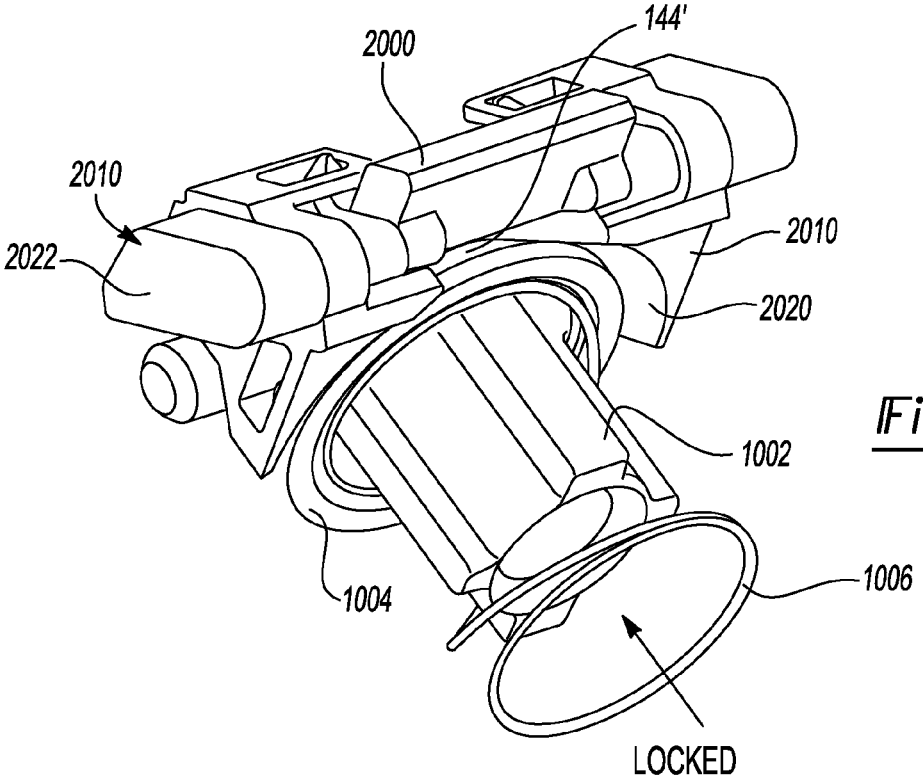
Figure 19:
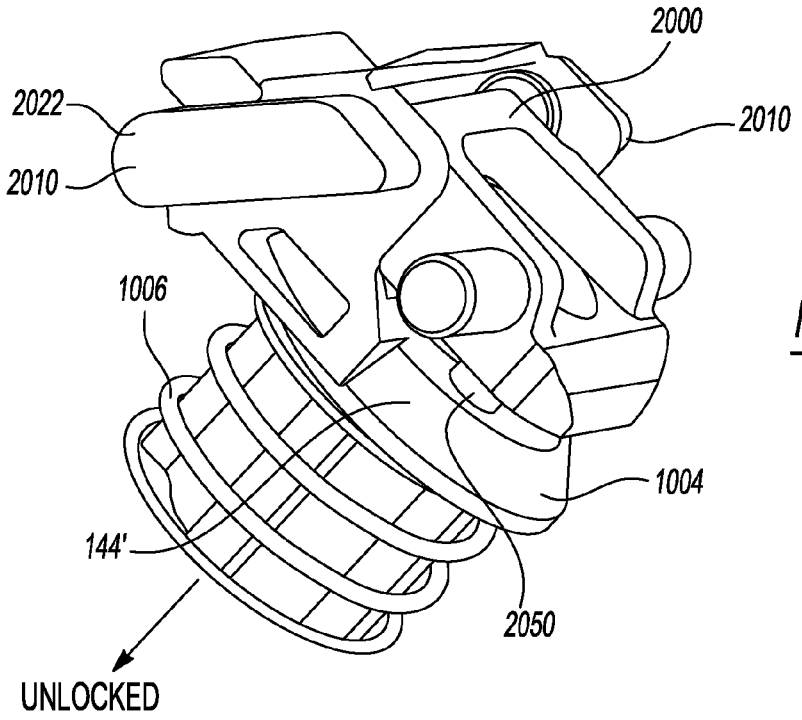
FIGS. 19 and 20 are perspective views of the portion of the power tool shown in FIG. 16, illustrating the locking mechanism in an unlocked condition.
Figure 20:
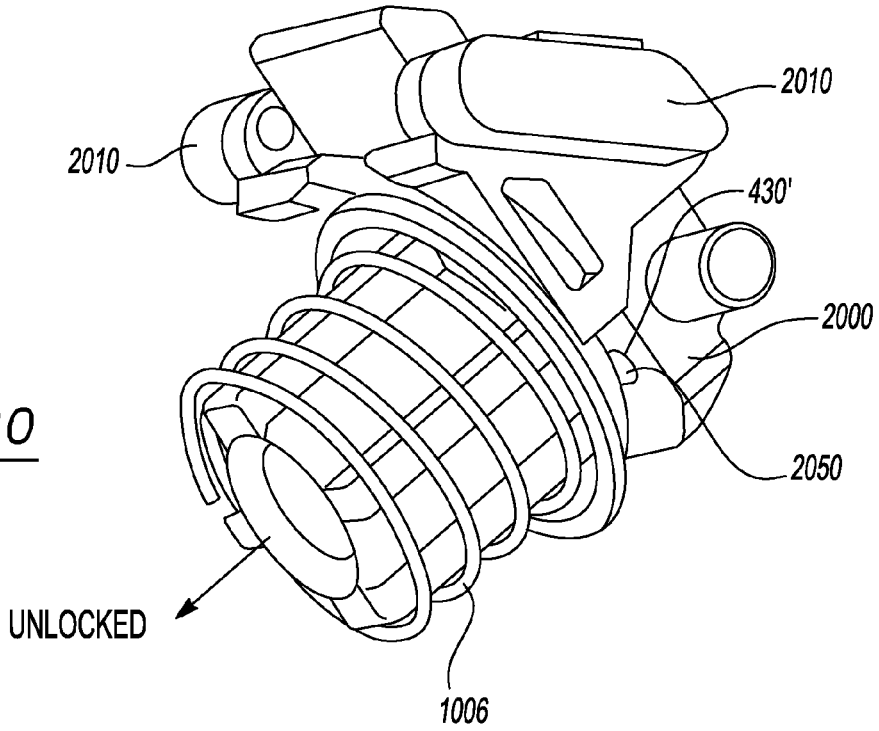

With additional reference to FIG. 16, the mounting hub 116' can have a hub shaft 1002 and a hub portion 1004 that can be fixedly coupled to a distal end of the hub shaft 1002. The hub shaft 1002 can be received through the mounting hub aperture 1000. The mounting hub aperture 1000 and the hub shaft 1002 can be shaped in a complementary manner that permits the mounting hub 116' to be non-rotatably but axially moveable along the rotational axis 36' relative to the first housing shells 50'. In the example provided, the hub shaft 1002 has a cruciform shape. A biasing spring 1006 can be received on the hub shaft 1002 between the hub portion 1004 and the first inclined wall 58' and can bias the mounting hub 116' away from the first inclined wall 58' along the rotational axis 36'. A proximal end of the hub shaft 1002 can be fixed to the first housing shells 50' in any desired manner to thereby limit the amount by which the hub shaft 1000 extends from the first inclined wall 58'. The hub portion 1004 can include a frustoconical portion 144'. A flange member 140' can be coupled to but spaced apart from the first inclined wall 58' by a distance that permits free rotation of the second housing portion 32' relative to the mounting hub 116'. In the example provided, a side of the flange member 140' that faces the first inclined wall 58' is formed parallel to the first inclined wall 58' and abuts a side of a second inclined wall 114' (FIG. 14) formed on the second housing portion 32' that is disposed opposite the first inclined wall 58'. The first stop member(s) 60' can be coupled to the flange member 140'.

Figure 15:
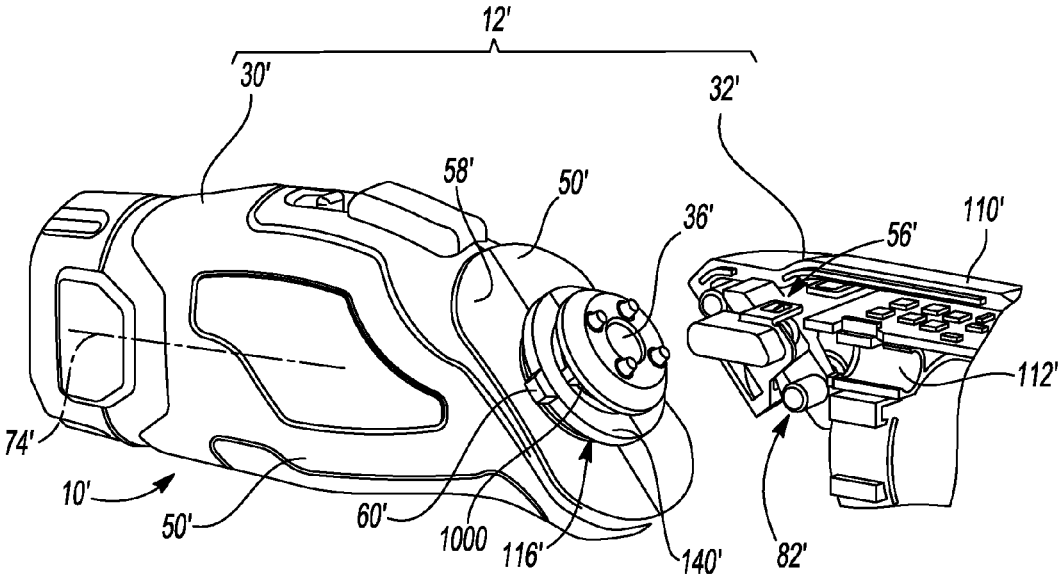
FIG. 15 is an exploded perspective view of a portion of the power tool of FIG. 13, illustrating the interface between the first and second housing portions in more detail.

With reference to FIGS. 14 and 15, the second housing portion 32' can comprise a pair of second housing shells 110' that can cooperate to define an internal cavity 112', a lock bar mount 56', a second inclined wall 114', and one or more second stop members (not specifically shown). The internal cavity 112' can be configured to house at least a portion of the powertrain 14'. The lock bar mount 56' can comprise a pair of rib structures (not specifically shown), with each of the rib structures being formed on a corresponding one of the second housing shells 110'. Each of the rib structures can be disposed partly or completely about a perimeter of a lock bar aperture 66' formed through an associated one of the second housing shells 110'. The second inclined wall 114', which can be disposed on a proximal end of the second housing portion 32', can be disposed transverse to a longitudinal axis 122' of the second housing portion 32' and perpendicular to the rotational axis 36'. In the particular example provided, the second inclined wall 114' is disposed at a 45 degree angle to the longitudinal axis 122' of the second housing portion 32'. The second inclined wall 114' can define a central aperture 82' that is configured to receive the portion of the first housing portion 30' located axially between the flange member 140' and the first inclined wall 58' such that the first and second inclined walls 58' and 114' are abutted against one another. The second stop member(s) can interact with the first stop member(s) 60 to limit rotation of the second housing portion 32' relative to the first housing portion 30'.

With reference to FIGS. 15 and 16, the locking system 18' can include a lock bar 420', a biasing system 422' and a set of mating stop members 1050. The lock bar 420' can include a bar body 430' and a set of stop members 434'. The bar body 430' can be fixedly coupled to the second housing portion 32' and can have a plate member 2000 and a pair of button guides 2002. The plate member 2000 can be aligned generally perpendicular to the rotational axis 36' and generally parallel to the second inclined wall 114'. The button guides 2002 can be posts or projections that can extend generally perpendicularly from the lateral sides of the plate member 2000. The set of stop members 434' can comprise a plurality of holes or recesses that can be formed in the plate member 2000 on a side that faces toward the first inclined wall 58'.

The biasing system 422' can comprise a pair of actuators 2010 and a pair of actuator springs 2012. Each of the actuators 2010 can comprise a beveled surface 2020, which can be engaged against the frustoconical portion 144' of the hub portion 1004 of the mounting hub 116', and an actuator button 2022 that can be received through an associated one of the second housing shells 110'. Each of the actuator springs 2012 can be a helical coil compression spring that can be received on a corresponding one of the button guides 2002 between the lock bar 420' and an associated one of the actuators 2010. The actuator springs 2012 are configured to bias the actuators 2010 away from (i.e., laterally away from) the lock bar 420'.

The set of mating stop members 1050 can be coupled to the hub portion 1004 of the mounting hub 116' and can be configured to engage the set of stop members 434' that are formed in the plate member 2000. In the particular example provided, the set of mating stop members 1050 comprise pins 2050 that extend from the hub portion 1004.

The beveled surfaces 2020 are shaped in such a way as to not interfere with the movement of the hub portion 1004 toward the lock bar 420' in response to the force applied to the hub portion 1004 by the biasing spring 1006 such that the mating stop members 1050 are permitted to engage the set of stop members 434'. Movement of the actuators 2010 in a direction toward the interior of the second housing portion 32' causes contact between the beveled surfaces 2020 of the actuators 2010 and the frustoconical portion 144' of the hub portion 1004, which drives the hub portion 1004 in a direction away from the lock bar 402' such that the mating stop members 1050 disengage the set of stop members 434'.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. A power tool comprising:

a first housing portion;

a second housing portion disposed about the first housing portion for pivoting motion about a pivot axis;

a powertrain having an output member, the output member extending from the second housing portion and being movable relative to an output member axis;

a mounting hub coupled to one of the first and second housing portions for movement along the pivot axis;

a lock bar mounted to the other one of the first and second housing portions;

a first set of stop members coupled to the mounting hub;

a second set of stop members coupled to the lock bar;

a spring biasing the mounting hub toward the lock bar to cause engagement of the first set of stop members with the second set of stop members;

an actuator coupled to the other one of the first and second housing portions, the actuator being configured to move the mounting hub away from the lock bar such that the first set of stop members disengages the second set of stop members;

wherein the second housing portion is inhibited from pivoting about the pivot axis relative to the first housing portion when the first set of stop members is engaged to the set of second stop members, and wherein the second housing portion is permitted to pivot about the pivot axis relative to the first housing portion when the first set of stop members is disengaged from the set of second stop members.

2. The power tool of claim 1, wherein the actuator is slidably mounted on the lock bar.

3. The power tool of claim 2, wherein an actuator spring is disposed between the actuator and the lock bar, the actuator spring biasing the actuator away from the lock bar.

4. The power tool of claim 1, wherein the mounting hub includes a frusto-conical portion and wherein the actuator contacts the frusto-conical portion of the mounting hub to cause the mounting hub to move away from the lock bar.

5. The power tool of claim 4, wherein the actuator comprises a beveled surface that contacts the frusto-conical portion.

6. The power tool of claim 1, wherein one of the set of first stop members and the set of second stop members comprises pins.

7. The power tool of claim 6, wherein the other one of the set of first stop members and the set of second stop members comprises holes that are configured to receive the pins.

8. A power tool comprising: a first housing portion;

a second housing portion disposed about the first housing portion for pivoting motion about a pivot axis;

a powertrain having an output member, the output member extending from the second housing portion and being movable relative to an output member axis;

a mounting hub coupled to one of the first and second housing portions;

a lock bar mounted to the other one of the first and second housing portions; and an actuator slidably received in the other one of the first and second housing portions, the actuator cooperating with the mounting hub to selectively permit the second housing portion to pivot about the pivot axis relative to the first housing portion;

wherein the actuator is slidably mounted on the lock bar.

9. The power tool of claim 8, wherein an actuator spring is disposed between the actuator and the lock bar, the actuator spring biasing the actuator away from the lock bar.

10. The power tool of claim 8, wherein the mounting hub includes a frusto-conical portion and wherein the actuator contacts the frusto-conical portion of the mounting hub to cause the mounting hub to move away from the lock bar.

11. The power tool of claim 10, wherein the actuator comprises a beveled surface that contacts the frusto-conical portion.

12. The power tool of claim 8, wherein a set of first stop members is coupled to the mounting hub and a second set of stop members is coupled to the lock bar.

13. The power tool of claim 12, wherein one of the set of first stop members and the set of second stop members comprises pins.

14. The power tool of claim 13, wherein the other one of the set of first stop members and the set of second stop members comprises holes that are configured to receive the pins.

15. A power tool comprising: a first housing portion;

a second housing portion disposed about the first housing portion for pivoting motion about a pivot axis;

a powertrain having an output member, the output member extending from the second housing portion and being movable relative to an output member axis;

a mounting hub coupled to one of the first and second housing portions;

a lock bar mounted to the other one of the first and second housing portions; and an actuator slidably received in the other one of the first and second housing portions, the actuator cooperating with the mounting hub to selectively permit the second housing portion to pivot about the pivot axis relative to the first housing portion;

wherein the lock bar is slidably mounted to the other one of the first and second housing portions.

16. The power tool of claim 15, wherein the lock bar directly engages the mounting hub to inhibit pivoting of the second housing portion relative to the first housing portion.

17. The power tool of claim 8, wherein the mounting hub is slidably mounted to the one of the first and second housing portions along the pivot axis.

18. The power tool of claim 17, wherein the mounting hub is non-rotatably coupled to the one of the first and second housing portions.

19. The power tool of claim 18, wherein the mounting hub has a hub shaft with a cruciform shape.

* * * * *